United States Patent [19]

Kulesza et al.

[11] 4,210,331

[45] Jul. 1, 1980

[54] ROTATABLE TARGET GAME

[75] Inventors: Ralph J. Kulesza, Chicago; John R. Wildman, N. Riverside; Henry Arias, Chicago; Jeffrey D. Breslow, Highland Park, all of Ill.

[73] Assignee: Marvin Glass & Associates, Chicago, Ill.

[21] Appl. No.: 876,413

[22] Filed: Feb. 10, 1978

[51] Int. Cl.[2] ..... A63D 3/02; A63F 7/10

[52] U.S. Cl. ..... 273/120 R; 273/123 R

[58] Field of Search ..... 273/110, 120 R, 120 A, 273/125 R, 125 A, 129 E, 122 R, 122 A, 127 R, 127 E, 123 R, 123 A, 124 R, 124 A

[56] References Cited

U.S. PATENT DOCUMENTS

| | | | |
|---|---|---|---|
| 1,022,847 | 4/1912 | Jaccard | 273/120 R |
| 1,104,469 | 7/1914 | Beseman | 273/125 R |
| 1,138,865 | 5/1915 | Hagerty | 273/127 E |
| 2,145,846 | 2/1939 | Cannon | 273/125 A |
| 2,490,288 | 12/1949 | Wickersham | 273/120 R |
| 3,498,615 | 3/1970 | Toutoundjis | 273/127 E |
| 3,542,367 | 11/1970 | Morehouse | 273/125 R |
| 3,840,235 | 10/1974 | Breslow | 273/119 A |
| 3,848,872 | 11/1974 | Velissaris | 273/125 R |
| 4,023,806 | 5/1977 | Wiser | 273/110 |
| 4,061,334 | 12/1977 | Kanno | 273/129 E |

FOREIGN PATENT DOCUMENTS

| | | | |
|---|---|---|---|
| 134644 | 5/1932 | Austria | 273/105.2 |
| 89395 | 5/1896 | Fed. Rep. of Germany | 273/127 E |
| 640361 | 12/1936 | Fed. Rep. of Germany | 273/110 |
| 737823 | 10/1932 | France | 273/120 R |
| 475381 | 10/1952 | Italy | 273/125 R |

*Primary Examiner*—Richard T. Stouffer

*Attorney, Agent, or Firm*—Mason, Kolehmainen, Rathburn & Wyss

[57] ABSTRACT

A game apparatus for use with play pieces and playable by one or more players, generally two, and including a playing area movable in a cyclical path during play by a suitable driving mechanism. The playing area has structure defining spaced play piece receiving and retention positions, which may be arranged in distinct sub-areas each having a plurality of the positions to receive and removably retain play pieces directed thereto for possible retention from one or more play piece launching stations adjacent the playing area. Selectively operable controls at the launching stations are operable by the players for directing their play pieces onto the area in an effort to score as by placing most pieces into the retention positions or in all the positions in one or more sub-areas. A stop is provided to stop movement of the playing area to permit removal of the play pieces for the starting of another game. The playing area has escape openings for play pieces not retained thereon from which the play pieces go to gathering and collecting means that direct them to holding chambers adjacent the launching means. Suitable score keeping boards are located near the holding chambers.

2 Claims, 6 Drawing Figures

ROTATABLE TARGET GAME

BACKGROUND AND SUMMARY OF THE INVENTION

This invention relates to game devices and provides a game apparatus using play pieces, such as marbles, and requiring manipulative skill and coordination to score effectively. There are many games of this general character but the apparatus of this invention is relatively inexpensive and easy to make, usable by players of varying ages and skill and may be played practically anywhere.

The apparatus includes a one-piece plastic base above which is mounted a central movable playing area such as a circular platform having a central hub for connection to a spring driven rotary motor and supporting a player operated motor spring winding knob. The platform has an outer annular region having spaced play piece receiving and retention positions onto which the play pieces are directed by the players from launching stations adjacent the outer edge of the platform. The positions are divided into distinct sub-areas each containing a number, such as three, of the positions. Play piece launching means, preferably one for each of two players, are located on the base at each launching station. Each launching means includes depressible control means enabling the pieces to be directed onto the platform while the latter is rotating and at a time when the player thinks the play piece will go into a particular retention position in a particular receiving and retention sub-area.

DESCRIPTION OF THE PREFERRED EMBODIMENT

Figures 1, 3, 4, 5, 6:
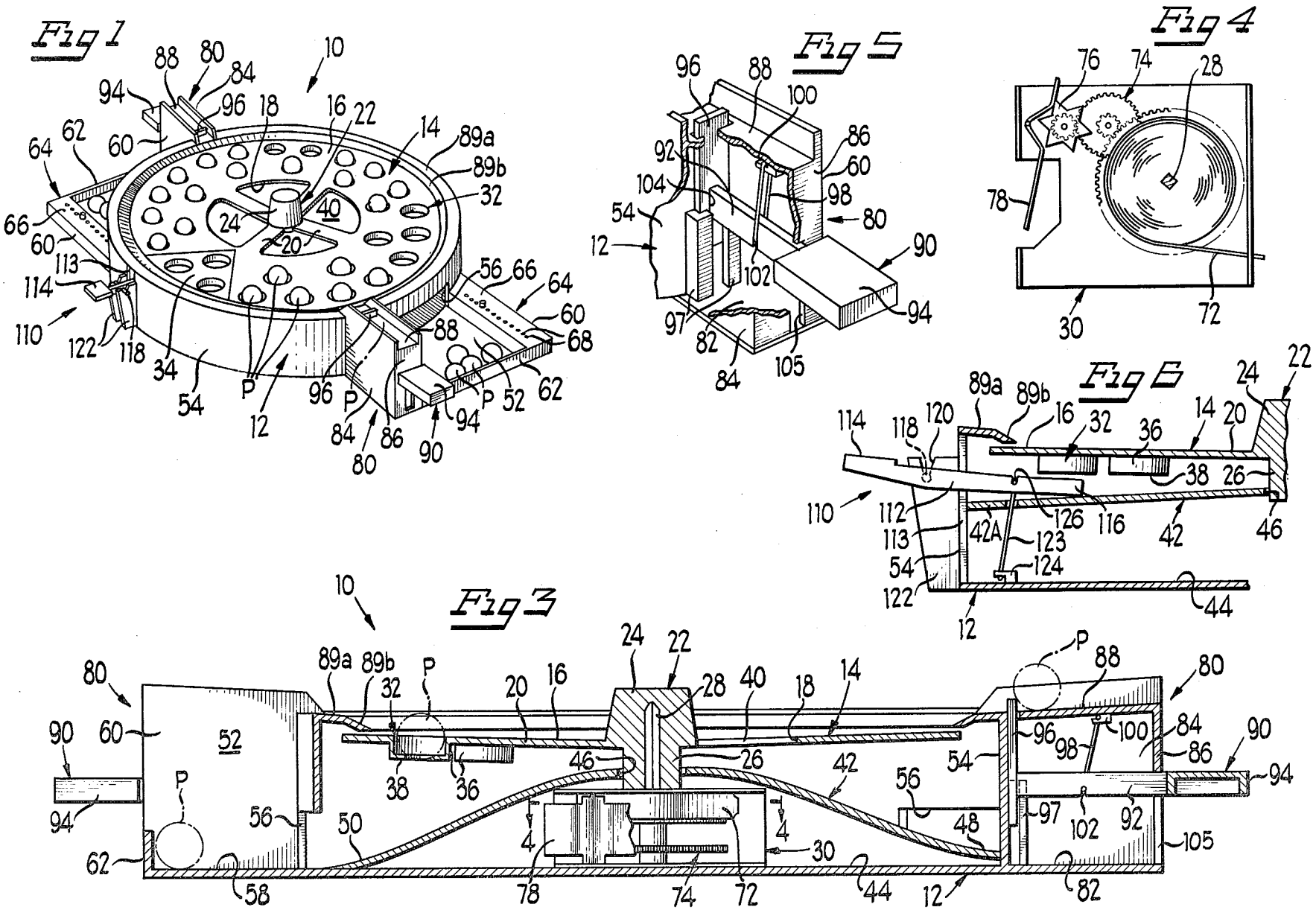
FIG. 1 is a perspective view of the game apparatus of the present invention and illustrating play pieces in various positions.
FIG. 3 is a vertical cross-sectional view along broken line 3—3 of FIG. 2.
FIG. 4 is a horizontal cross-sectional view taken along line 4—4 of FIG. 3.
FIG. 5 is a fragmentary, partly broken away, perspective cross-sectional view of selectively operable play piece control means.
FIG. 6 is a fragmentary vertical cross-sectional view along line 6—6 of FIG. 2 and illustrating details of a stop mechanism for the movable playing area.
Figure 2:
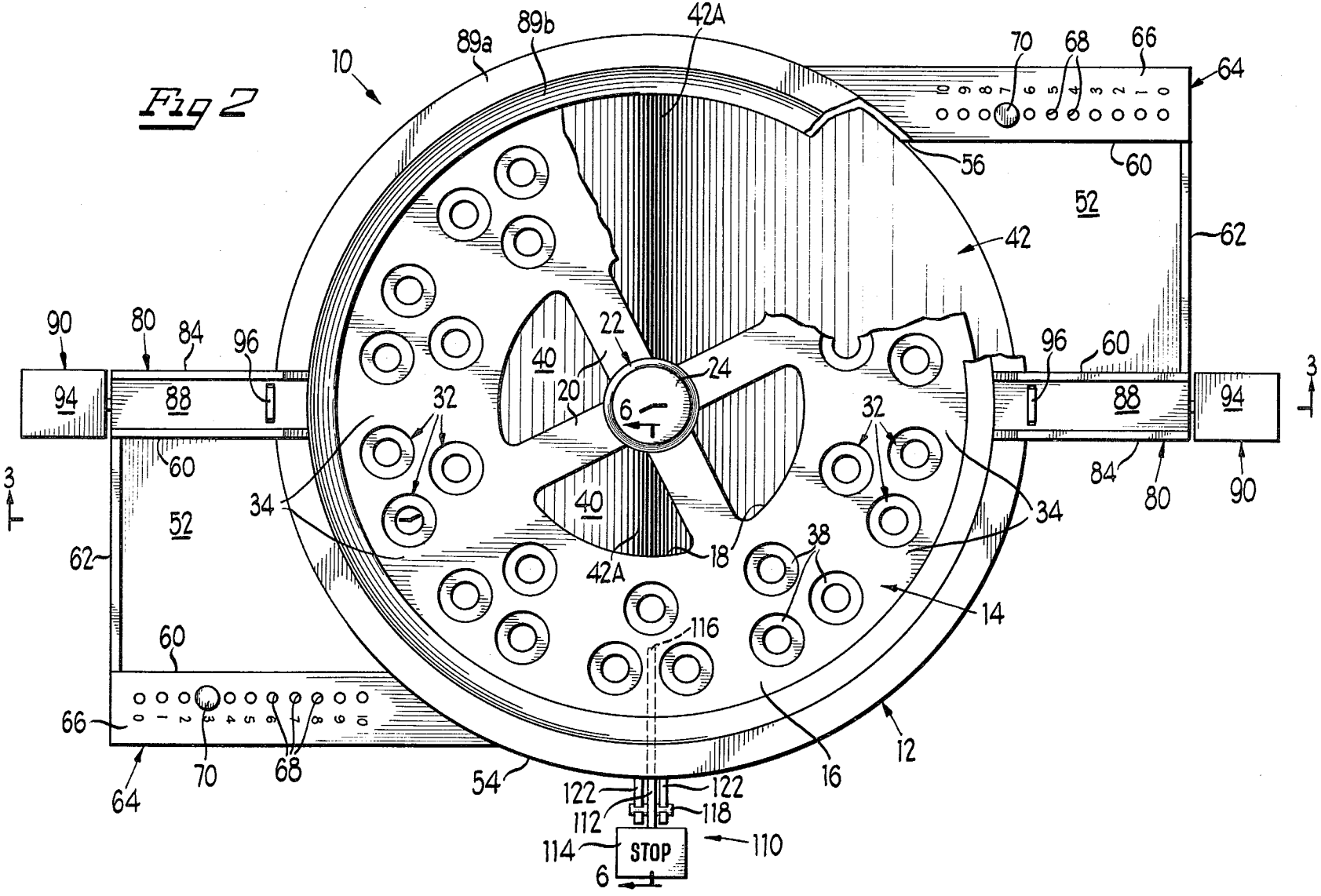
FIG. 2 is an enlarged top plan view, partly broken away, of the apparatus but omitting the play pieces.

The game apparatus of the present invention is best illustrated as a whole by reference character 10 in FIGS. 1, 2 and 3 to which reference is first had. It is conveniently and inexpensively made primarily of plastic material, but other materials may be used. It includes two major components, these being a base 12 and a playing area 14; the play pieces being indicated by reference character P and preferably constituted by spheres, such as balls, marbles or the like.

The playing area may take various shapes, but it is shown as a circular platform 16 having an outer annular portion 18 connected by narrow spokes 20 to a central hub portion 22, all these parts being made as an integral structure. The hub portion has a central upstanding knob 24 and a lower dependent portion 26 and into which is embedded the vertically upstanding polygonal drive shaft 28 of a drive motor 30 (see FIG. 3) which will be described in greater detail hereinafter and which drives the playing area in a cyclical, such as rotary, path.

The outer annular portion 18 of the playing area is provided with spaced structures defining play piece retaining positions 32. These are divided into a plurality of distinct play piece receiving and retention sub-areas, some of which have been indicated by reference characters 34, and each sub-area may include several play piece retaining positions, three being shown in FIG. 1. The structure include cup-like depressions having dependent circular side walls 36 and a centrally apertured bottom 38. The depressions have a depth equal approximately to the radius of and a diameter slightly greater than that of a spherical play piece. If other shapes are utilized, the outer structures would have to be used. In any event, the structures are such that they will, without undue difficulty, receive and removably retain a play piece directed onto the moving play area.

Play pieces not caught and retained in positions 32 move toward the center of the playing area, the latter being slightly concave or centrally depressed in shape, as best shown in FIG. 3. As a result, they reach the escape spaces or openings 40 between spokes 20.

Playing pieces reaching the escape openings 40 fall below the rotatable platform onto a gathering and guiding partition 42 located above the central portion of bottom plate 44 of the base 12. Partition 42 is generally convex in shape, with a diametral higher portion 42A (FIGS. 2 and 6) and apertured centrally at 46 for passage of control knob portion 26. The convexity causes play pieces to gravitate to the outer peripheral portions 48 and 50 (see FIG. 3). The latter are inclined from the higher diametral portion 42A to guide the play pieces to holding chambers 52, of which two are shown, and which are at the outside of the circular outer wall 54 of the base. Apertures 56 are provided in wall 54 for the passage of play pieces from the central portion of the base and partition 42 into the chambers 52. Each chamber includes a bottom 58, side walls 60 and an end wall 62.

A pair of score keeping boards 64 are associated with side walls 60. Each comprises a top 66 with a series of numbered holes 68 adapted to receive score keeping pegs 70 to record the player's score.

The playing area 14 is rotated by the motor 30, which may be of known construction. It rotates the shaft 28 and control knob 24, the latter being used to wind the motor spring 72 that drives through gears 74 at a speed controlled by star wheel 76 and associated flipper 78. A motor that can be used is a well-known Aladdin motor operating at a suitable speed of about 4 rpm.

One or more, preferably two, play piece launching stations 80 are positioned at opposite sides of and adjacent to the playing area for directing play pieces onto the area for possible retention in retention positions 32. Each station includes a bottom 82, a wall 60 and an opposed wall 84, a front wall 86 and a top wall 88 below the tops of walls 60 and 84 and inclined toward the playing area and down which the play pieces are directed to the playing area. The top walls 88 lead to a circular inner two-part peripheral ledge **89*a*, 89*b* that extends from wall 54 to over the outer edge of playing area 14 (see FIG. 3). At the launching stations, the ledge portions constitute an extension, so to speak, of the top 88** down which the play pieces are directed.

The play pieces are selectively directed to the playing area down the launching stations by player operated control means 90 comprising a depressible lever 92 having an operating knob 94 at its end and effective, when depressed to release a play piece by lowering a gate 96 vertically movable in spaced runners 97 (FIG. 5). Gate 96 projects through launching station top 88 and normally prevents movement of a play piece. When knob 94 is depressed, the lever 92 moves downward against resilient biasing means constituted as by a rubberband 98 extending from the support 100 at the underside of top 88 and the groove 102 at the underside of lever 92 intermediate the ends of the latter. The inner end of lever 92 fits into a recess 104 in gate 96 and the outer end projects through slot 105. The arrangement is such that the lever and stop move vertically rather than pivotally.

Movement of the playing area may be stopped by the stopping means 110 illustrated best in FIG. 6. This means includes a lever 112 projecting through slot 113 in wall 54 and having an outer operating button 114 and an inner end 116 and pivoting about a transverse pivot shaft 118 passing through the lever and supported in V-shaped grooves 120 in spaced vertical supports 122 at the exterior of wall 54 of the base structure. When knob 114 is depressed, lever 112 pivots and inner end 116 is moved upwardly to engage a side of a wall retention cup 32 to stop rotation of the playing area. The lever is biased into the position of FIG. 6 as by a rubberband 123 extending between base support 124 and groove 126 at the upper side of the lever. The limit position of the lever is determined by engagement of lever end 116 with partition portion 42A.

In reviewing the operation, it is assumed there are two players and each has a set of differently colored balls P that are stored in a players chamber 52. The control knob 24 is turned to wind or energize the spring motor 30. The players each place a ball in launching station 80, where it is held by gate 96 until a control button 94 is operated to open the gate and a ball is launched onto the playing area.

The apparatus may be used to play different games. A relatively simple game is for the players, in turn, or at the same time, to attempt to get the most balls into the ball retention cups 32 when the playing area is moving. The player filling the most cups in a period of time or when all are filled would be the winner.

The apparatus is capable of being utilized in a more complicated game by having both players direct balls onto the moving playing area at the same time and each player attempting to get three balls into all the retention positions in a particular sub-area 34 before his oponent got one in. On the other hand; the opponent would try to get a ball into a sub-area in which the other has one or two positions filled, thereby neutralizing that position.

Balls not held in retention positions roll through openings 40 to the ball gathering means 42 for return down the partition 42 and inclined surfaces 48 and 50 to the chambers 52 for replay.

If the motor slows down or stops during play, control knob 24 can be readily turned to re-energize the motor.

Whenever a sub-area has been filled with balls of one color, the player playing that color can mark his success on scoreboard 64. Or, the individual balls placed in position may be recorded.

The foregoing detailed description has been given for clearness of understanding only and no unnecessary limitations should be understood therefrom as some modifications will be obvious to those skilled in the art.

We claim:

1. A game apparatus for use with play pieces such as marbles, comprising:

a base having a horizontal bottom, an upstanding circular side wall and a central top opening defined by a peripheral flange extending inwardly and downwardly from the top of said side wall;

a circular playing board mounted on said base and having a central hub, radially extending spaced spokes and an outer annular area, the outer peripheral portion of which extends underneath said flange and said annular area being inclined downwardly and centrally;

means connected to said hub for rotating the playing board;

said annular area having a plurality of spaced cup-shaped downwardly extending receptacles constituting marble retention positions to receive and removably retain marbles entering them;

a pair of spaced marble launching stations located on the base at the exterior of said side wall and including marble receiving channels for directing marbles onto said flange and annular area for possible retention in said receptacles;

selectively operable control means at each launching station including a resiliently upwardly biased gate normally preventing movement of a marble and a depressible control lever for lowering said gate to launch a marble;

a pair of spaced marble gathering chambers at the exterior of said side wall, one adjacent each launching station;

marble gathering means underneath said spokes for receiving marbles falling between the spokes and contoured to guide them to said gathering chambers; scoring areas adjacent said chambers; and board stopping means comprising a lever extending through and pivoted on the side wall normally disengaged from said playing board and manually movable into engagement with the underside of the board and a receptacle to stop rotation of the board.

2. A game apparatus comprising:

a plurality of rollable playing pieces;

a base having a horizontal bottom, an upstanding side wall and a central top opening defined by a peripheral flange extending inwardly and downwardly from the top of said side wall;

a circular playing board mounted on said base and having a central hub and an outer annular area, the outer peripheral portion of which extends underneath said flange and said annular area being inclined slightly downwardly and centrally;

means connected to said hub for rotating the playing board;

said annular area having a plurality of spaced receptacles constituting playing piece retention positions to receive and removably retain playing pieces entering them;

a pair of playing piece launching stations located on the base at the exterior of said side wall and including receiving channels for directing playing pieces onto said annular area for possible retention in said receptacles;

selectively operable control means at each launching station normally preventing launching of a playing piece and a depressible control lever for launching a playing piece;

a pair of playing piece holding chambers at the exterior of said side wall, one adjacent each launching station;

gathering means underneath said playing board for receiving playing pieces and contoured to guide them to said holding chambers;

scoring areas adjacent said holding chambers; and stop means to selectively stop rotation of the board.

* * * * *